US008137249B2

(12) United States Patent
Koch et al.

(10) Patent No.: US 8,137,249 B2
(45) **Date of Patent: *Mar. 20, 2012**

(54) EXERCISE APPARATUS

(75) Inventors: Kregg Alan Koch, Aliso Viejo, CA (US); Michael Shannon Kadar, Red Deer (CA)

(73) Assignee: Core Stix Fitness LLC, Manhattan Beach, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/767,767

(22) Filed: Apr. 26, 2010

(65) Prior Publication Data

US 2010/0273615 A1 Oct. 28, 2010

Related U.S. Application Data

(63) Continuation of application No. 11/533,766, filed on Sep. 21, 2006, now Pat. No. 7,704,199.

(60) Provisional application No. 60/721,669, filed on Sep. 29, 2005.

(51) Int. Cl.
*A63B 21/02* (2006.01)
*A63B 21/04* (2006.01)

(52) U.S. Cl. ..... 482/123; 482/121; 482/129; 482/130

(58) Field of Classification Search ..... 482/121, 482/123, 126, 130, 907, 127, 129
See application file for complete search history.

(56) References Cited

U.S. PATENT DOCUMENTS 3,345,067 A 10/1967 Smith
3,567,219 A * 3/1971 Foster ..... 482/130
3,587,319 A 6/1971 Andrews
3,802,701 A 4/1974 Good
3,807,727 A * 4/1974 Ferguson ..... 482/71
(Continued)

FOREIGN PATENT DOCUMENTS

WO WO 82/00100 1/1982

OTHER PUBLICATIONS

U.S. Appl. No. 13/018,307, filed Jan. 31, 2011 and its ongoing prosecution history, including without limitation Office Actions, Amendments, Remarks, and any other potentially relevant documents.

(Continued)

*Primary Examiner* — Loan Thanh
*Assistant Examiner* — Sundhara Ganesan
(74) *Attorney, Agent, or Firm* — Knobbe, Martens, Olson & Bear LLP

(57) ABSTRACT

This description is not intended to limit the scope of the claims herein. An exercise device comprising a base that can be oriented at any angle and that defines a plurality of connection interfaces, each of which is designed to carry and restrain one end of a cantilevered resilient member. Said connection interfaces can be positioned at or adjusted to a widely varying range of locations and angular orientations with respect to the base. The resilient members can be affixed to any of the connection interfaces that the user desires, so that the resilient members can be positioned in a correspondingly wide range of locations and angular orientations relative to the base to enable the user to perform a wide range of exercises on the apparatus by gripping and exerting a force on the resilient members or other handles attached to the resilient members.

62 Claims, 10 Drawing Sheets

U.S. PATENT DOCUMENTS

| | | | | | |
|---|---|---|---|---|---|
| 4,332,399 | A | | 6/1982 | Kepple | |
| 4,494,662 | A | | 1/1985 | Clymer | |
| 4,535,991 | A | * | 8/1985 | Boatright | 482/91 |
| 4,620,704 | A | * | 11/1986 | Shifferaw | 482/130 |
| 4,625,963 | A | | 12/1986 | Lancellotti | |
| 4,725,057 | A | | 2/1988 | Shifferaw | |
| 4,822,039 | A | * | 4/1989 | Gonzales et al. | 482/146 |
| 5,013,034 | A | | 5/1991 | March et al. | |
| 5,064,190 | A | * | 11/1991 | Holt | 482/70 |
| 5,123,886 | A | | 6/1992 | Cook | |
| 5,395,296 | A | * | 3/1995 | Webster et al. | 482/130 |
| 5,403,256 | A | * | 4/1995 | Squires | 482/91 |
| 5,522,783 | A | | 6/1996 | Gordon | |
| 5,524,893 | A | | 6/1996 | McGinnis et al. | |
| 5,755,649 | A | | 5/1998 | Bimby | |
| 5,759,139 | A | * | 6/1998 | Wright | 482/128 |
| 5,860,897 | A | | 1/1999 | Gilbert et al. | |
| 5,913,754 | A | | 6/1999 | Lochbaum | |
| 5,971,891 | A | | 10/1999 | Humphrey | |
| 6,406,410 | B1 | | 6/2002 | Lochbaum | |
| 6,676,579 | B1 | * | 1/2004 | Lin | 482/146 |
| 6,872,174 | B2 | * | 3/2005 | Benach | 482/121 |
| 6,964,636 | B2 | * | 11/2005 | Verheem et al. | 482/121 |
| 7,041,041 | B1 | * | 5/2006 | Evans | 482/126 |
| 7,309,303 | B1 | * | 12/2007 | Proctor | 482/121 |
| 7,704,199 | B2 | * | 4/2010 | Koch et al. | 482/130 |
| 2003/0162638 | A1 | * | 8/2003 | Verheem et al. | 482/123 |
| 2003/0186792 | A1 | | 10/2003 | Keeler | |
| 2004/0097350 | A1 | * | 5/2004 | Beutel | 482/121 |
| 2004/0235624 | A1 | * | 11/2004 | Bruce | 482/125 |
| 2005/0107228 | A1 | * | 5/2005 | Brown | 482/121 |
| 2005/0233877 | A1 | * | 10/2005 | Lin | 482/126 |

OTHER PUBLICATIONS

Supplementary European Search Report from the European Patent Office for Application No. 06803914.8/Publication No. 1928561, document mailed on Jan. 5, 2009 in 8 pages.

Office Action dated Apr. 15, 2009, from EP Application No. 06803914.8.

Response to Office Action dated Oct. 13, 2009, from EP Application No. 06803914.8.

Office Action dated Mar. 29, 2010, from EP Application No. 06803914.8.

Response to Office Action dated Oct. 8, 2010, from EP Application No. 06803914.8.

Office Action dated Nov. 20, 2009, from Canadian Application No. 2,623,744.

Response to Office Action dated May 20, 2010, from Canadian Application No. 2,623,744.

Office Action dated Oct. 7, 2010, from Canadian Application No. 2,623,744.

Office Action dated Aug. 21, 2009, from Chinese Application No. 200680036255.7.

Response to Office Action dated Mar. 5, 2010, from Chinese Application No. 200680036255.7.

International Search Report from PCT/US06/36639, dated Sep. 25, 2007, 11 pages.

* cited by examiner

EXERCISE APPARATUS

CROSS-REFERENCE TO RELATED APPLICATIONS

This application is a continuation of U.S. application Ser. No. 11/533,766, filed Sep. 21, 2006 now U.S. Pat. No. 7,704,199, which claims the benefit of U.S. Provisional Patent Application Ser. No. 60/721,669, titled CORE STRENGTH RESISTANCE ROD EXERCISE APPARATUS, filed Sep. 29, 2005. The present application also claims the benefit of U.S. Provisional Patent Application Ser. No. 60/721,669. The full disclosure of U.S. application Ser. Nos. 11/533,766 and 60/721,669 are hereby incorporated by reference as if fully set forth herein.

BACKGROUND OF THE INVENTION

The present invention relates to the field of exercise equipment utilizing cantilevered, resilient members for resistance. There are presently several known types of exercise machines and devices available on the market utilizing cantilevered, resilient members to provide resistance training. One such device, the Isotonic-Isometric Device for Exercise and Physical Therapy, U.S. Pat. No. 5,522,783, comprises a single cantilevered, elongated exercise rod attached to a socket that is mounted to a metal base. Different forms of the mounting apparatus, including a vacuum cup for surface mounting, a clamp for table or desk edge mounting, or a special mounting assembly for doorway mounting, permit the metal base supporting the single resilient member to be mounted to various surfaces or objects. The Isotonic-Isometric Device is limited to a single resilient member and is not free standing but, rather, depends upon the availability of a suitable mounting surface or object. Additionally, the magnitude of resistance that can be achieved by the Isotonic-Isometric Device is directly dependant on the robustness of the mounting apparatus and the surface or object that this device is mounted to, and the orientation of the resistance member is not readily adjustable.

Another device that utilizes resilient members to provide resistance training, through a cable pulley system, is the Universal Exercising Machine, U.S. Pat. No. 4,620,704. Generally, this device comprises a collapsible, rigid frame, a plurality of cantilevered resilient members, two cables connecting a handle attachment to the cantilevered resilient members, and a sliding bench. The cables are necessary components to operate this device. To utilize this device, the user grips the chosen handle attachment and exerts a force on the cables causing the cantilevered resistance members to bend and, hence, generate resistance. Resistance is generated by the cantilevered, resilient members when the cables are pulled by the user. Because the cables, which are a necessary element of the Universal Exercising Machine, cannot transfer compressive forces, the resistance generated by this device is uni-directional only.

BRIEF SUMMARY OF THE INVENTION

The exercise apparatus of the present invention is not limited to the following description. The following is meant merely as a brief summary of the general features of the exercise apparatus of the present invention. A more complete written description is listed below. The exercise apparatus of the present invention comprises a base member that can be free standing or mounted to any horizontal, vertical, or angled surface. Resilient members, such as rods of plastic, can be removably or permanently mounted in a cantilevered fashion to the base member at any of a wide range of locations or angular orientations, so that one end of the resilient member is fixed to the base member and the other end of the resilient member is unrestrained. The user can perform a wide range of strength and physical therapy exercises for many if not all of the various muscle groups of the body by grasping the somewhat stiff resilient members in his or her hands and exerting a force on the unrestrained portion of the resilient member in any direction that is generally transverse to the longitudinal centerline of the resilient member, causing the resilient member to bend in flexure. The resilient members are preferably designed to enable multi-directional resistance and can be used independently or simultaneously, permitting the user to exercise multiple different muscles simultaneously. The apparatus is preferably designed so that it can support the user in a free standing, kneeling, or sitting position, or any other position that will maximize core strength training in a manner not generally feasible with conventional devices comprising flat benches, walls, or other similar stabilizing structures. Further, the exercise apparatus of the present invention can be readily configured for home use with little instruction to enable the user to exercise and strengthen virtually every muscle group and/or joint of the body and at any widely variable level of resistance by changing the orientation, location, and/or stiffness of the resilient members.

Other objects and features of the present invention will become apparent from the following detailed description taken in connection with the accompanying drawings. It is to be understood, however, that the drawings are designed for the purpose of illustration only and are not intended as a definition of the limits of the invention.

DETAILED DESCRIPTION

An exercise apparatus of the present invention comprising one or more resilient members for exercising is described herein. In the following description, numerous specific details are set forth by way of exemplary embodiments in order to provide a more thorough description of the present invention. It will be apparent, however, to one skilled in the art that the present invention may be practiced without these specific details. Unless specifically noted, it is intended that the words and phrases in the specification and claims be given the ordinary and accustomed meaning as understood by those of ordinary skill in the applicable art or arts. If any other meaning is intended, that special meaning will be disclosed herein. Furthermore, the scope of the present invention is not limited by the specific details of the embodiments described below. As an example, the number, location, and orientation of the connection interfaces 56 of each of the embodiment of the exercise apparatus of the present invention are not limited to the number, location, and orientation of the connection interfaces 56 illustrated herein.

Figure 1:
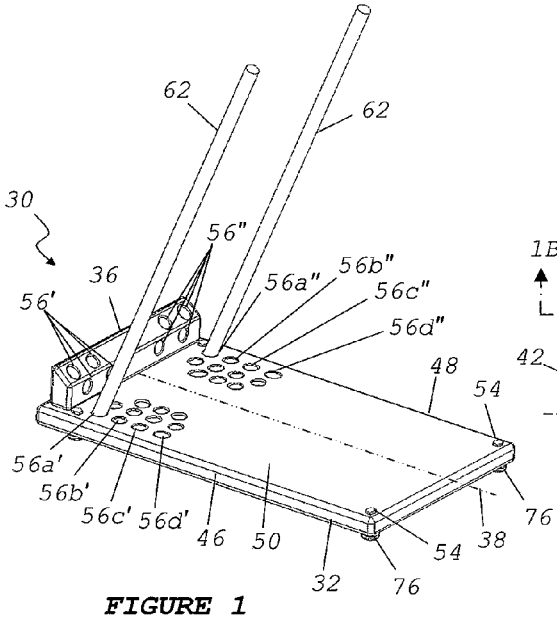
FIG. 1 is a perspective view of an embodiment of the exercise apparatus of the present invention.
Figure 1A:
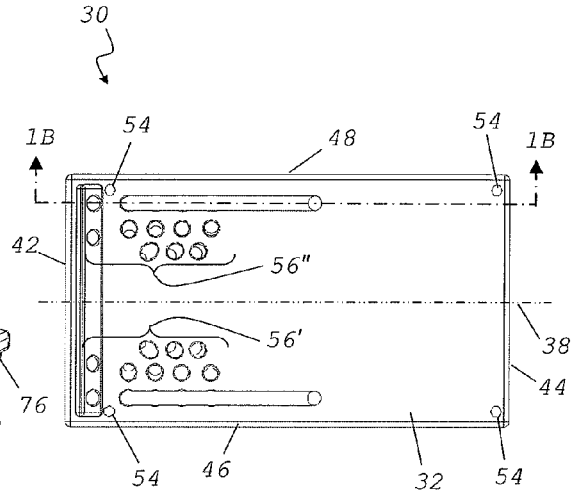
FIG. 1*a* is an aerial view of the embodiment of the exercise apparatus of the present invention illustrated in FIG. 1.
Figure 1B:
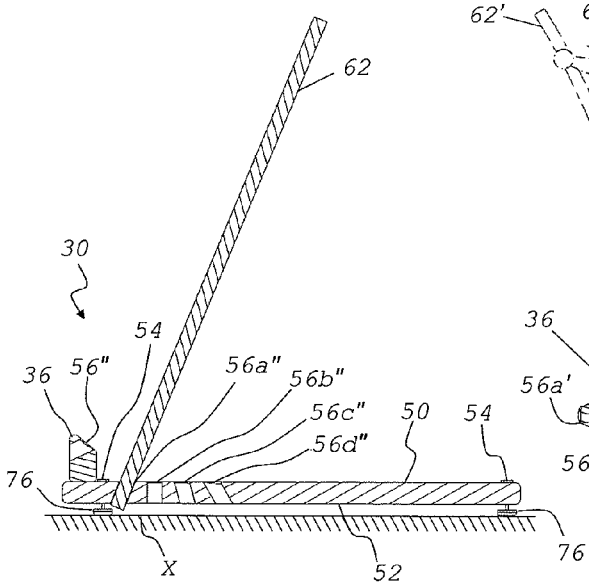
FIG. 1*b* is a sectional view of the embodiment of the exercise apparatus of the present invention illustrated in FIGS. 1 and 1*a* taken along line 1*b*-1*b* in FIG. 1*a*.
Figure 2:
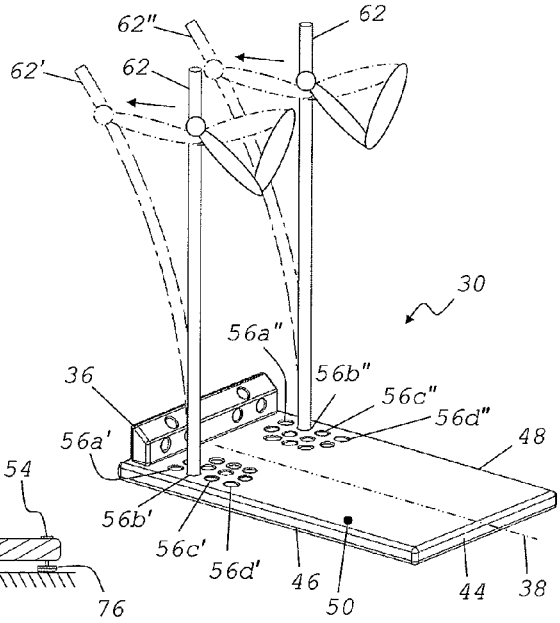
FIGS. 2 through 10 illustrate various applications of the exercise apparatus of the present invention.

Referring now in detail to the drawings, the embodiment of the exercise apparatus of the present invention illustrated in each of the FIGS. 1, 1*a*, and 1*b* comprises a base 30 and a pair of resilient members 62. The base 30 illustrated in FIGS. 1, 1*a*, and 1*b* is free standing, horizontally oriented, and is resting on ground surface X. Other embodiments of the base can be oriented horizontally, vertically, or at any other angle, and can either free standing or can be fixed to a supporting surface. The base 30 illustrated in FIGS. 1, 1*a*, and 1*b* is preferably designed to support the user of the exercise apparatus in a standing, kneeling, sitting or other position and carries one end of the resilient members 62. The base 30 can be formed in a wide variety of configurations. In the embodiments illustrated in FIGS. 1, 1*a*, and 1*b*, base 30 also comprises protruding base portion 36, back surface 42, front surface 44, left surface 46, right surface 48, primary surface 50, a plurality of left side connection interfaces 56' located between centerline 38 and left surface 46, and a plurality of right side connection interfaces 56" located between centerline 38 and right surface 48. The embodiment of each connection interface of the present invention is preferably configured to provide a removable securement for an end portion of a resilient member such that the resilient member extends therefrom in a cantilevered disposition and can be formed of a channel either partially or fully protruding through the base. The connection interfaces 56 illustrated in FIG. 1 preferably define an inner surface having substantially the same geometrical configuration as the outer surface of the portion of the resilient member 62 (i.e., either the fixed end of the resilient member 62' or the insert 64) that is in communication with the connection interface 56. The left and right side connection interfaces 56' and 56" are preferably positioned on the base 30 at a wide-ranging variety of locations and angular orientations relative to the base. In the embodiments of the exercise apparatus illustrated in FIGS. 1-10, left side connection interfaces 56' are located and oriented symmetrically with respect to right side connection interfaces 56" about centerline 38 so that the user can simultaneously perform identical exercise motions on the left and right side of the users body, as illustrated in FIG. 2. However, the exercise apparatus of the present invention is not so limited. The exercise apparatus of the present invention permits a widely variable number of locations and orientations of the connection interfaces 56 relative to the user beyond those illustrated in FIG. 1 or any other figure herein, and while the symmetry of the left side connection interfaces 56' with respect to the right side connection interfaces 56" is preferable, it is not required.

Resilient members 62 are preferably formed from a rod of resilient plastic and can be removably or permanently attached to any connection interface 56 such as any of the left side connection interfaces 56', the right side connection interfaces 56" illustrated in FIGS. 1-10, and/or in any other connection interface 56 illustrated in any of the embodiments described herein or within the scope of the present invention. For many exercises, the user would prefer only one or two resilient members 62 to be simultaneously attached to the connection interfaces 56. The connection interfaces 56 effectively restrain one end of the resilient member 62 in a cantilevered fashion so that the user can perform exercises by grasping the unrestrained portion, of the resilient members 62 in his or her hands and exerting a generally transverse force on the unrestrained portion of the resilient member, causing the resilient member to bend in flexure. The stiffness of the resilient member provides the resistance needed for performing the desired exercises. The resilient members preferably permit multi-directional resistance and can preferably be used independently or simultaneously, permitting the user to perform multiple different exercises simultaneously.

Figure 12:
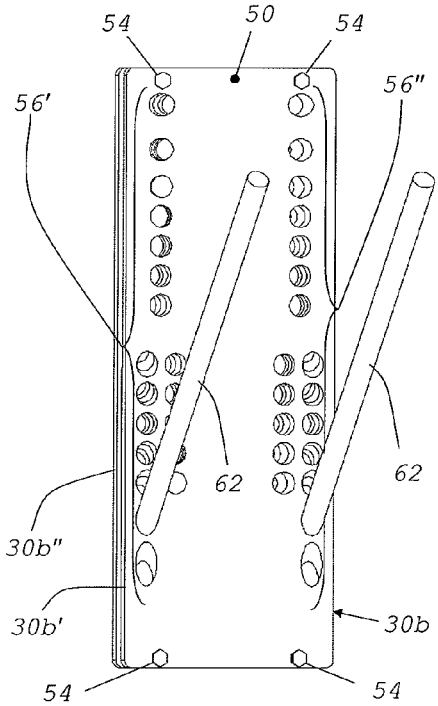
FIG. 12 is a perspective view of an embodiment of the exercise apparatus of the present invention.
Figure 13:
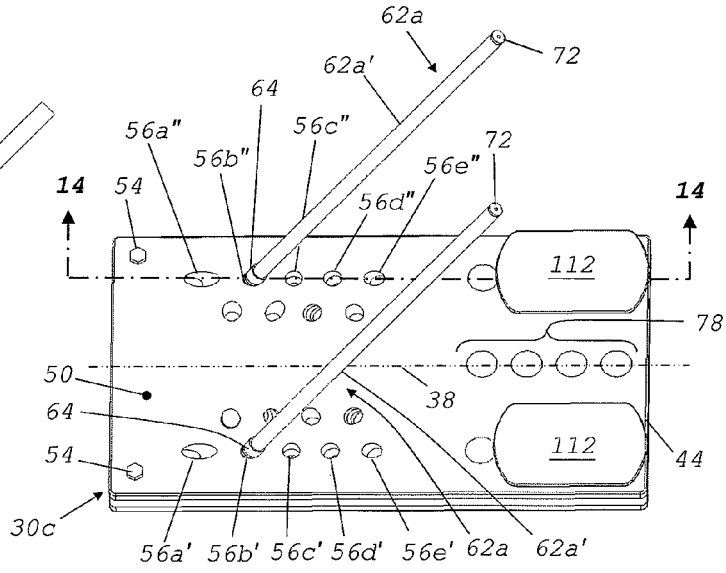
FIG. 13 is a perspective view of an embodiment of the exercise apparatus of the present invention.
Figure 14:
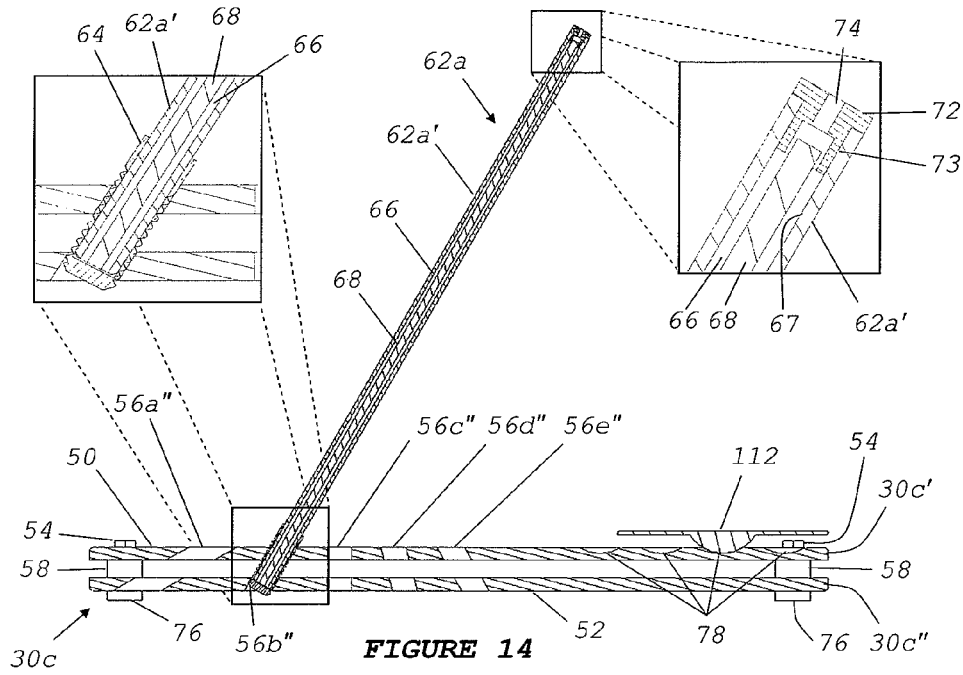
FIG. 14 is a sectional view of the embodiment of the exercise apparatus of the present invention illustrated in FIG. 13 along line 14-14.

The protruding base portion 36 preferably comprises additional connection interfaces 56 at a wide range of locations and angular orientations relative to the user. The protruding base portion 36 can be formed in a wide variety of configurations and can be bolted, screwed, hinged, welded, glued, or otherwise permanently or removably fastened to the base using any suitable or similar means of attachment. When the base is generally horizontally oriented, such as when resting on a ground surface, the base 30 can preferably support the weight of the user of the device positioned in a two leg stance, one leg stance, kneeling, sitting, or in any similar or desired exercise position on the primary surface 50. Further, a wobble board 112 of the kind found in the prior art, as illustrated in FIGS. 13 and 14, or a balance platform, or any other similar rehabilitation, exercise, or balance training devices, can also be used with the present invention to increase the difficulty and, hence, the benefit of using the exercise apparatus of the present invention. The base 30 and protruding base portion 36 can be manufactured from any generally stiff material, including wood, plastic, fiber reinforced plastic, metal, or any composite thereof. In the embodiments disclosed herein, the perimeter of the base 30 can be any geometry such as a square, rectangle, circle, oval, or any other desired shape. The embodiments of the base 30 designed for horizontal orientation preferably have a width of approximately twenty-four inches to approximately thirty-six inches and a length of approximately forty-eight inches. The embodiments of the base 30 designed for vertical orientation, as illustrated in FIG. 12, preferably have a width of approximately three inches to approximately thirty-six inches and a height preferably in the range of approximately twelve inches to approximately seventy-two inches. However, the dimensions of the base 30 are not so confined. The base can formed in a wide variety of configurations and dimensions beyond those illustrated and described herein. Additionally, stiffening members, "I" beams, or other structural members manufactured from any generally stiff material, including plastic, fiber reinforced or otherwise, metal, or any composite thereof, can be attached to base 30 to increase the rigidity of the base. Such stiffener panels, "I" beams, or other structural members would be preferably attached to the bottom surface 52 of the base 30. The base 30 can comprise base pads 76 attached to the base using bolts 54, which can serve multiple functions. First, the length of the base pads 76 can be adjusted so as to level the base on uneven surfaces. Additionally, as illustrated most clearly in FIGS. 1*b* and 12*a*, base pads 76 provide space between the bottom base surface 52 and the ground X or wall W so that the resilient members 62 can be fully engaged in the connection interfaces 56 without interference with the ground surface or wall.

Figure 19:
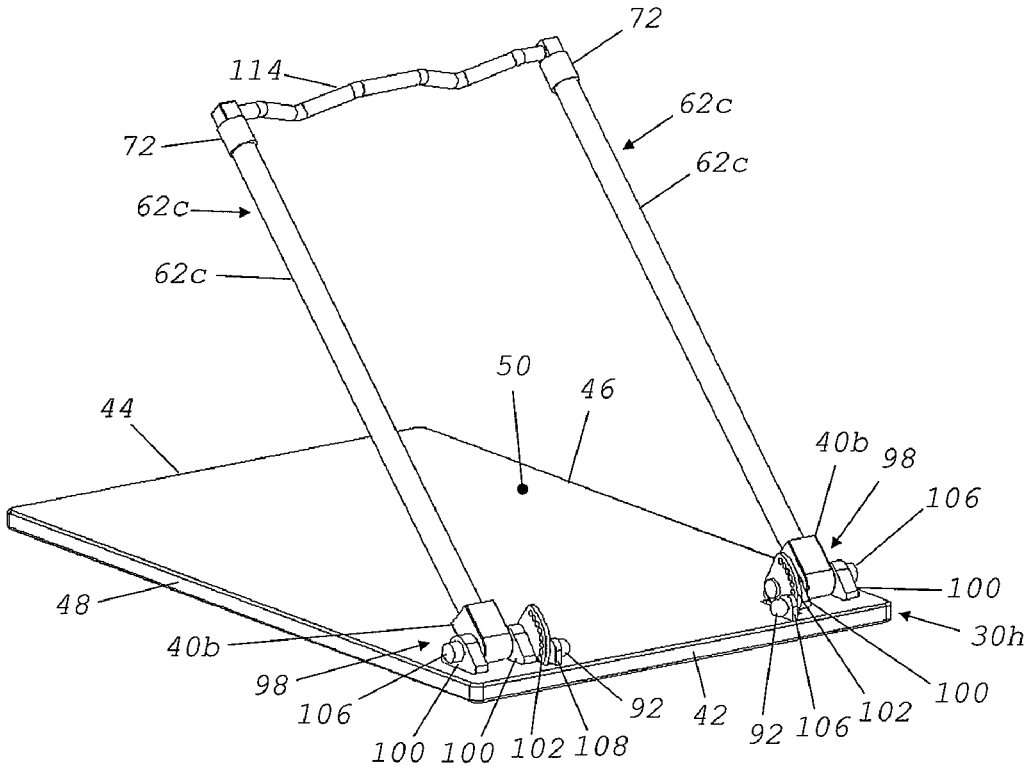
FIG. 19 is a perspective view of an embodiment of the exercise apparatus of the present invention.

The operation of the present invention will be described with reference to FIGS. 2-10 and examples of different exercises that can be performed using the exercise apparatus of the present invention. Each of these exercises has a primary benefit to particular muscle groups of the user's body, which are identified in the descriptions below. The following descriptions are not, however, exhaustive of the capabilities of the exercise apparatus of the present invention but merely disclose some of these capabilities so that the reader better understands some modes of operation of the exercise apparatus of the present invention. FIGS. 2-10 contain schematic illustrations of the user's upper forearms and upper arms (each represented by ovals), hands (represented by circles), lower and upper legs (represented by ovals), or feet (represented by rectangles), as well as other parts of the body necessary for understanding. Solid lines are used to represent the initial position of the user's body parts and resilient members 62. Dashed lines are used to represent the positions of the body parts and resilient members 62' and 62" after force has been applied to the resilient members 62 for the particular exercise described. A wide-ranging variety of exercises can be performed on the exercise apparatus of the present invention by varying the location, orientation, and posture of the user relative to the base 30, by varying the location and orientation of the resilient members 62 relative to the user, by varying the level of resistance of the resilient members 62, or by using different handles as illustrated in FIG. 19.

FIG. 2 illustrates the use of the exercise apparatus of the present invention for exercising mostly the chest, shoulders, and arms. In FIG. 2, the user stands upright on primary surface 50 at the lateral center of the base 30 facing two resilient members 62 that are attached to connection interfaces 56*b*' and 56*b*" spaced approximately the user's shoulder width apart. For this exercise, the user stands close to and grips the resilient members 62 with bent arms, and simultaneously pushes each of the resilient members 62 away from the user's body to resilient member positions 62' and 62", and then returns the resilient members 62 to their initial position. This exercise is known as the chest press. Other exercises can be performed by inserting resilient members 62 into connection interface 56*a*', 56*b*', 56*c*', or 56*d*', and 56*a*", 56*b*", 56*c*", or 56*d*", each of which has a different angular orientation. As discussed, each connection interface is designed to restrain one end of the resilient member 62. Thus, varying the angular orientation of the connection interfaces 56 varies the angular orientation of the resilient members relative to the user such that the user can perform different exercises by attaching the resilient member to a different connection interface.

Figure 3:
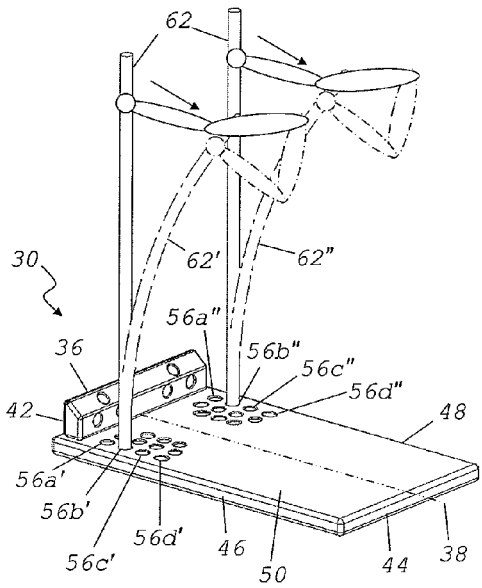

FIG. 3 illustrates the use of the exercise apparatus of the present invention for exercising mostly the upper and mid back, shoulders, and arms. In FIG. 3, the user stands upright on primary surface 50 at the lateral center of the base 30 at approximately an arm's length distance from the two vertically oriented resilient members 62 again inserted into connection interfaces 56*b*' and 56*b*". Grasping the resilient members 62 directly with his or her hands, the user simultaneously pulls the resilient members 62 toward the user's body to resilient member positions 62' and 62", and then returns the resilient members 62 to their initial position.

Figure 4:
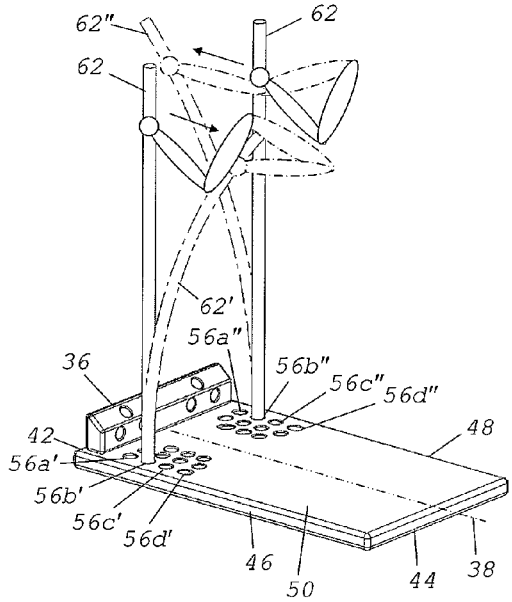

The exercise illustrated in FIG. 4 is a combination of the exercises performed in FIGS. 2 and 3. For this exercise, the user stands upright on primary surface 50 at the lateral center of the base 30 with arms slightly bent in front of the user's body, grasping the resilient members 62 again inserted into connection interfaces 56*b*' and 56*b*" The user first pushes the resilient member 62 located in connection interface 56*b*", bending the resilient member 62 to position 62". This mostly exercises the right side of the user's chest, shoulders, and arms. The user simultaneously pulls the resilient member 62 located in connection interface 56*b*', bending the resilient member 62 to position 62'. This mostly exercises the left side of the user's upper and mid back, shoulders, and arms. The user then returns both resilient members 62 to the original position and then alternates the forces applied to each resilient member 62 such that the user applies a pulling force to the resilient member 62 located in connection interface 56*b*" and a pushing force to the resilient member 62 located in connection interface 56*b*' and then, again, returning both resilient members 62 to their initial position. By alternating, the user is able to simultaneously exercise back, shoulder, arm, and chest muscles.

Figure 5:
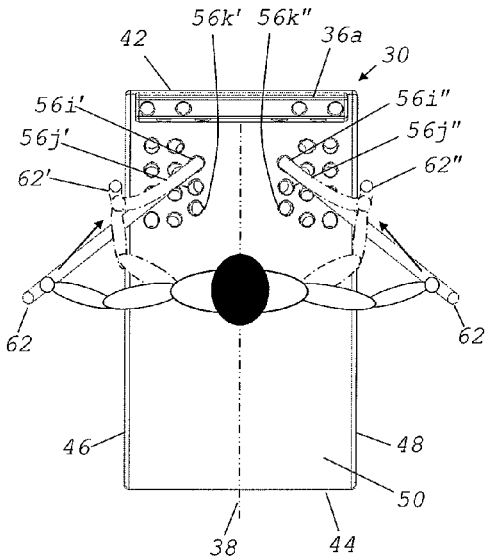

FIG. 5 illustrates the use of the exercise apparatus of the present invention for upper body conditioning exercise mostly for the chest, anterior shoulder, and arms. For this exercise, the user stands on primary surface 50 in an upright position at the lateral center of the base 30 facing two resilient members 62 that are inserted into connection interfaces 56*i*' and 56*i*", which are spaced laterally narrower that the user's shoulder width and angled back toward but laterally away from the user's body. For this exercise, the user extends his or her arms laterally so that his or her hands are approximately shoulder height with arms slightly bent, grasps the resilient members 62 directly with his or her hands, simultaneously pushes the resilient members 62 forward toward resilient member positions 62' and 62", and then returns the resilient members 62 to the initial position. The user can alter the motion of this exercise by inserting resilient members 62 into any of the other connection interfaces 56*i*', 56*j*', or 56*k*', and 56*i*", 56*j*", or 56*k*", each of which hosts a different angular orientation relative to the user.

Figure 6:
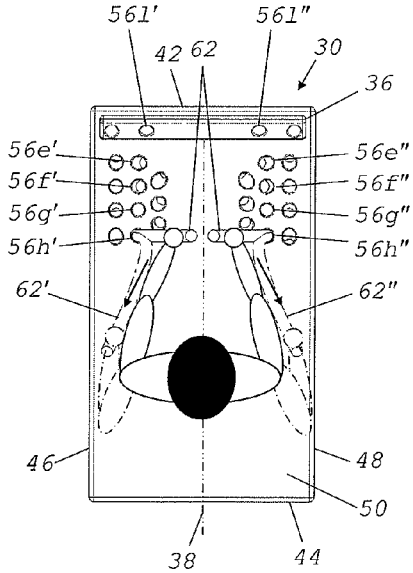

FIG. 6 illustrates the use of the exercise apparatus of the present invention for upper body conditioning exercise mostly for the upper and mid back, shoulders, and arms. For this exercise, the resilient members 62 are inserted in connection interfaces 56*h*' and 56*h*", which are both oriented such that the tops of each of the resilient members 62 are angled toward the base centerline 38. The user begins the exercise with each of his or her hands in a closer proximity to one another and pulls each of the resilient members 62 at a slightly outward angle relative to base centerline 38, forcing the resilient members 62 to bend to resilient member positions 62' and 62", and then returns the resilient members 62 to their initial position.

Figure 7:
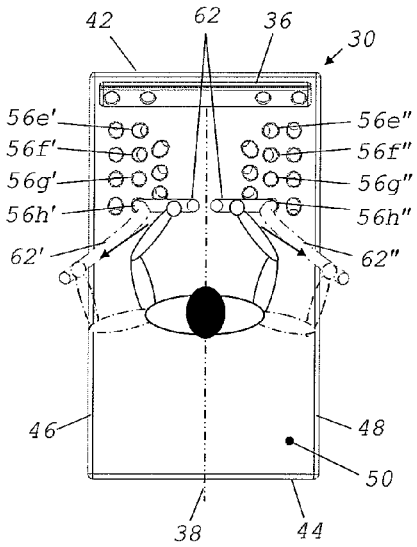

FIG. 7 illustrates the use of the exercise apparatus of the present invention for upper body conditioning exercise mostly for the upper back, shoulders, and arms. The user stands on primary surface 50 in an upright position at the lateral center of the base 30 with arms extending in front of the user's body but slightly bent, elbows in line with the user's shoulder and hand, facing resilient members 62 inserted in connection interfaces 56*h*' and 56*h*". Grasping the resilient members 62, the user simultaneously pulls each of the resilient members 62 away from base centerline 38 and away from back surface 42 in a controlled movement to resilient member positions 62' and 62", and then returns the resilient members 62 to their initial position.

Figure 8:
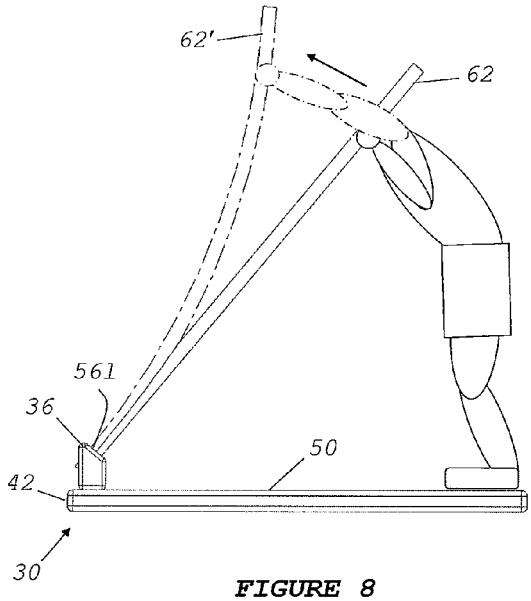

FIG. 8 illustrates the use of the exercise apparatus of the present invention for upper body conditioning mostly for the upper shoulders and arms. For this exercise, the user stands on primary surface 50 at the lateral center of the base 30 with knees slightly bent and waist slightly bent so that his or her upper body is angled forward, gripping resilient members 62, inserted in connection interfaces 56*l*, just above the user's shoulders. The user simultaneously pushes each of the resilient members 62 up and away from the user's shoulders to resilient member position 62' and then returns the resilient members to the initial position.

Figure 9:
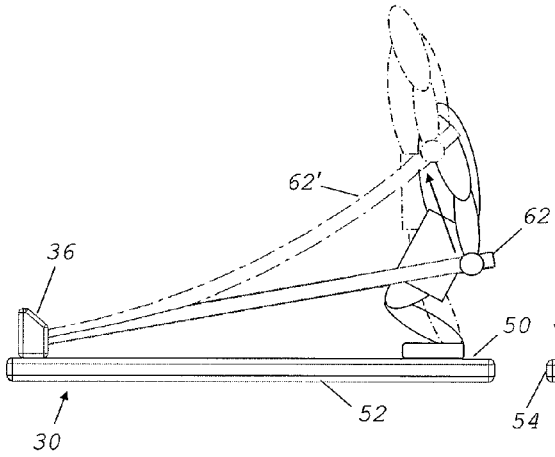

FIG. 9 illustrates the use of the exercise apparatus of the present invention for upper body conditioning exercise mostly for the upper and lower legs, upper cervical musculature, upper trapezius shoulders, and lower back. This exercise is known as a squat shrug. For this exercise, the user stands on primary surface 50 at the lateral center of the base 30 facing protruding base portion 36, with knees bent, upper body mostly upright, and with arms straight down at the user's sides, gripping both resilient members 62 just below the user's knees. Using mainly leg and trapezius muscles, the user thrusts upward straightening his or her knees to a standing position while simultaneously shrugging his or her shoulders upward to resilient member positions 62' and then returns the resilient members 62 to their initial position.

Figure 10:
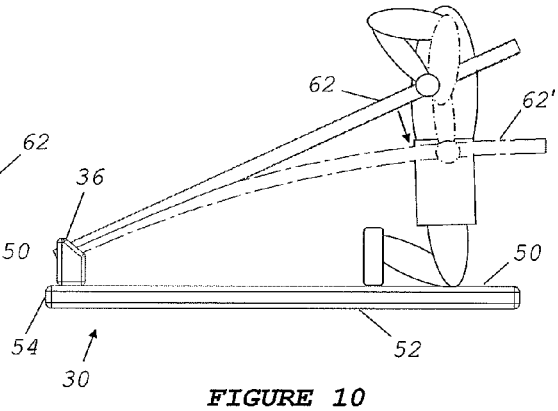

FIG. 10 illustrates the use of the exercise apparatus of the present invention mainly for exercising the user's arms. For this exercise, the user kneels on primary surface 50 with back and knees bent facing away from protruding base portion 36, with arms by his or her side and bent at the elbows, gripping resilient members 62 inserted in connection interfaces 56*o*' and 56*o*". The user either simultaneously or independently pushes each of the resilient members 62 down toward primary surface 50 to resilient member positions 62' using mainly only his or her arms, and then returns the resilient members 62 to their initial position.

Figure 11:
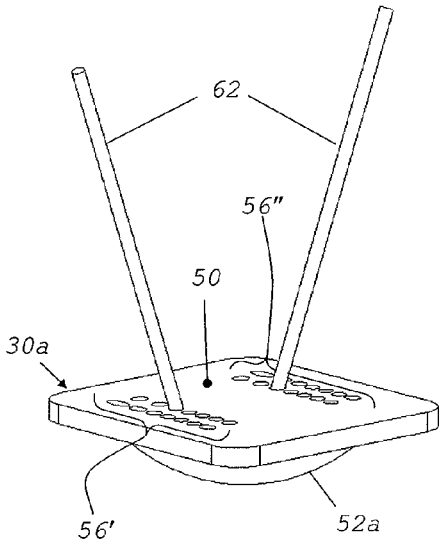
FIG. 11 is a perspective view of an embodiment of the exercise apparatus of the present invention.

The embodiment of the exercise apparatus of the present invention illustrated in FIG. 11 comprises base 30*a*, which is generally horizontally oriented and has a non-flat bottom surface 52*a*, and resilient members 62 inserted in connection interfaces 56. Base 30*a* is wide enough for the user to stand with his or her feet approximately a shoulder distance apart and comprises a plurality of connection interfaces 56 at a wide ranging variety of locations and angular orientations. Portions of the base 30*a* can be made from a material such as metal, plastic, or any other sufficiently rigid material, while other portions such the bottom surface 52*a* can optionally be made from a pliable material such as rubber or a soft plastic. Having a non-flat bottom surface increases the difficulty and, hence, improves the conditioning benefit to the user by requiring the user to maintain his or her balance while exercising.

Figure 12A:
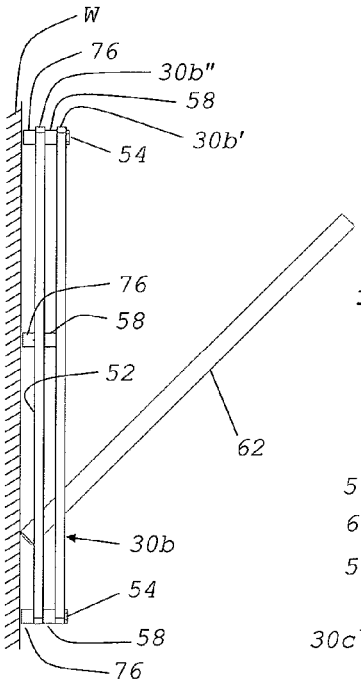
FIG. 12*a* is a side view of the embodiment of the exercise apparatus of the present invention illustrated in FIG. 12.

The embodiment of the exercise apparatus of the present invention illustrated in FIGS. 12 and 12*a* comprises a two layer base defining an upper base portion 30*b*' and lower base portion 30*b*" spaced apart by base member spacers 58 and affixed together using base bolt 54, and a plurality of connection interfaces 56 at a wide range of locations and angular orientations. Base 30 is generally vertically oriented and attached to a vertical wall surface W using bolts 54, but can be attached to the wall surface, or any other surface, using bolts, screws, adhesive, welds, or any other similar or suitable attachment means. Base pads 76 preferably provide enough space between the bottom surface 52 and the vertical wall surface W to enable the resilient members 62 to fully engage in the connection interfaces to prevent their inadvertent removal without interference with the wall surface. For this embodiment, the user performs many of his or her desired exercises while standing on the ground, either facing toward or away from primary surface 50. Base pads 76 are preferably attached to bottom surface 52 of this or any other base illustrated or described herein using screws, bolts, adhesive, welds, or any other suitable attachment means to enable the user to level the base and to provide a space between the base bottom surface 52 and the supporting surface.

The embodiment of the exercise apparatus of the present invention illustrated in FIGS. 13 and 14 comprises base 30*c*, which is generally horizontally oriented, and resilient members 62*a* inserted in threaded connection interfaces 56*b*' and 56*b*". The base 30*c* of the embodiment of the exercise apparatus illustrated in FIGS. 13 and 14 is made from two base member portions 30*c*' and 30*c*" formed from a wide ranging array of materials such as plastic, metal, wood, fiberglass, or any other similar or suitable material. The base member portions 30*c*' and 30*c*" are oriented generally parallel to one another and fixed together using base member spacers 58 and base bolts 54. Base 30*c* further comprises a plurality of base depressions 78, twelve being shown, each designed for receiving and limiting the lateral movement of a wobble board 112 or other similar device to increase the difficulty of exercises performed by making the user's stance unstable. The number, geometric configuration, and location of each of the base depressions 78 is widely variable. In the embodiment of the exercise apparatus of the present invention illustrated in FIGS. 13 and 14, each of the left side connection interfaces 56' have a different location and angular orientation, and are each symmetrical with the right side connection interfaces 56" about centerline 38.

In addition to being comprised only of a single resilient member, the resilient member of each of the embodiments disclosed in this patent can be comprised of multiple components, as is the resilient member 62' shown in FIGS. 13 and 14. The resilient members 62*a* shown in FIGS. 13 and 14 are each comprised of a resilient member 62*a*' that has a longitudinal bore 66 extending longitudinally therethrough, a threaded insert 64 which is attached to one end of the resilient member and inserted into the connection interface, a stiffener member 68 inserted into the longitudinal bore 66, and cap 72 that is attached to the unrestrained end of the resilient member to seal the longitudinal bore 66. Again, the resilient members 62*a* shown in FIGS. 13 and 14 are an alternate embodiment of the other embodiments of the resilient members 62 illustrated or described herein and can be used interchangeably with any of the resilient members, base embodiments, and connection interface embodiments disclosed herein. For the resilient members 62*a* shown in FIGS. 13 and 14, the stiffener member 68 is formed of a resilient rod that can be inserted into the longitudinal bores 66 to increase the resistance provided by the resilient member 62*a* and can be of any cross-section, round or otherwise, or can be in the form of a helical spring or similar configuration. The cap 72 is preferably fixed to the free end of the resilient member to seal the longitudinal bore 66 and also to serve as an interface with any handle or other similar attachment that the user desires to attach to the resilient members 62*a*. The cap 72 preferably defines a hole 74 which enables a handle to be bolted to the cap 72. Cap surface 73 and the portion of the inner bore surface 67 at the unrestrained end of the resilient member preferably comprise threads, pins, channels, protrusions, or other suitable locking features to prevent the inadvertent removal of the cap 72.

In the embodiment of the resilient member 62*a* illustrated in FIGS. 13 and 14, each insert 64 and each connection interface 56 are preferably threaded or comprise other suitable locking features so that, when the inserts 64 are inserted into the connection interfaces, the inserts 64 and, hence, the resilient members 62*a*, will not become inadvertently disengaged during use. Each insert 64 also serves another function—to provide a common interface with the connection interfaces. A resilient member with a non-circular cross-section could not be securely inserted into a cylindrical connection interface. An insert 64 with a circular cross-sectional portion can be affixed to the end of the non-circular resilient member so that the resilient member can be inserted into the cylindrical connection interface. Furthermore, an effective way to vary the resistance of the exercise is to vary the cross-sectional thickness of the resilient member 64. Attaching an insert 64 with a portion that matches the geometry of the connection interfaces 56 to the end of each such varying resilient member would overcome the mismatch that would otherwise prevent the resilient members of varying cross-sectional configurations that do not match the configuration of the connection interfaces from inserting into the connection interfaces. Thus, each insert 64 provides an interface between the resilient member and the connection interfaces so that resilient members of varying diameter or cross-sectional geometry can be inserted in the same connection interface.

Figure 15:
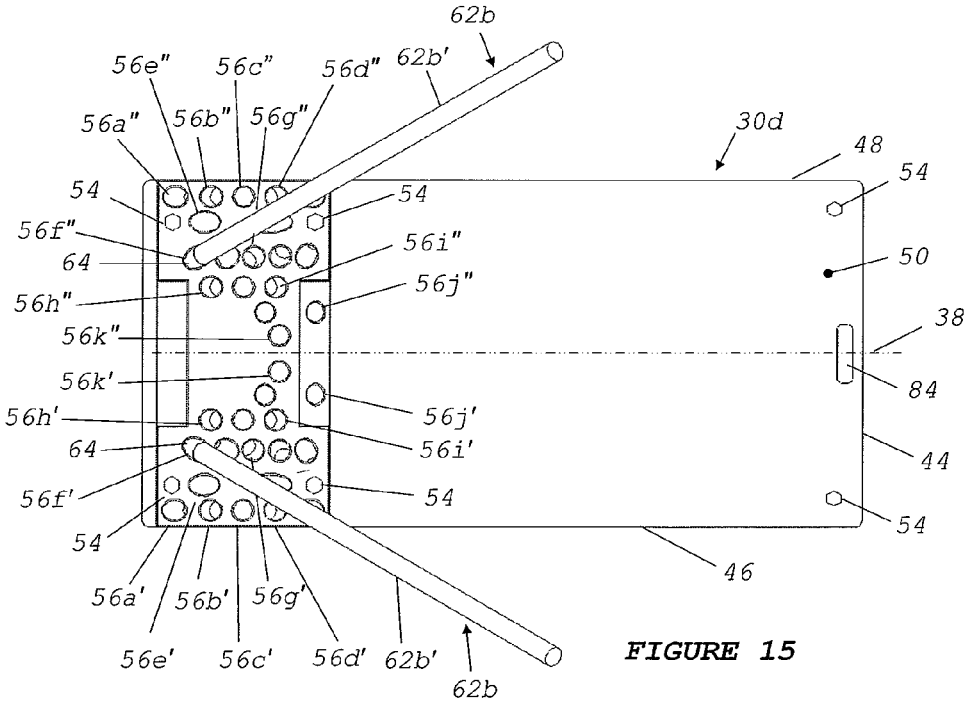
FIG. 15 is an aerial view of an embodiment of the exercise apparatus of the present invention.
Figure 15A:
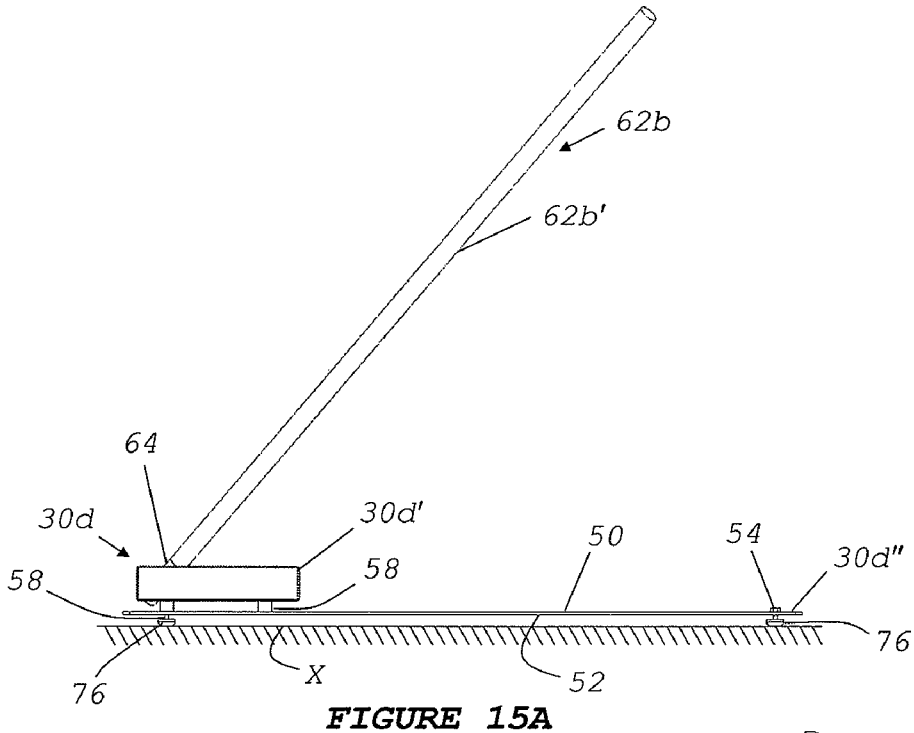
FIG. 15*a* is a side view of the embodiment of the exercise apparatus of the present invention illustrated in FIG. 15.

The embodiment of the present invention illustrated in FIGS. 15 and 15*a* comprises base 30*d*, which is generally horizontally oriented, and two resilient members 62*b*, each of which is comprised of resilient member 62*b*' and insert 64. Base 30*d* is defined by upper base portion 30*d*' and lower base portion 30*d*" attached together using bolts 54 and spacers 58. Base 30*d* defines a handle 84 to facilitate the transport of the base. Connection interfaces 56 are preferably formed in the upper base portion 30*d*' only and base spacers 58 provide space between the upper base portion 30*d*' and lower base portion 30*d*" to ensure that the resilient members can be sufficiently engaged in the connection interfaces without interference with the lower base portion 30*d*". Upper base portion 30*d*' is thick enough in cross-section to enable the resilient members 62' to engage in the connection interfaces 56 to a depth sufficient to secure the resilient members and to prevent their inadvertent removal.

Figure 16:
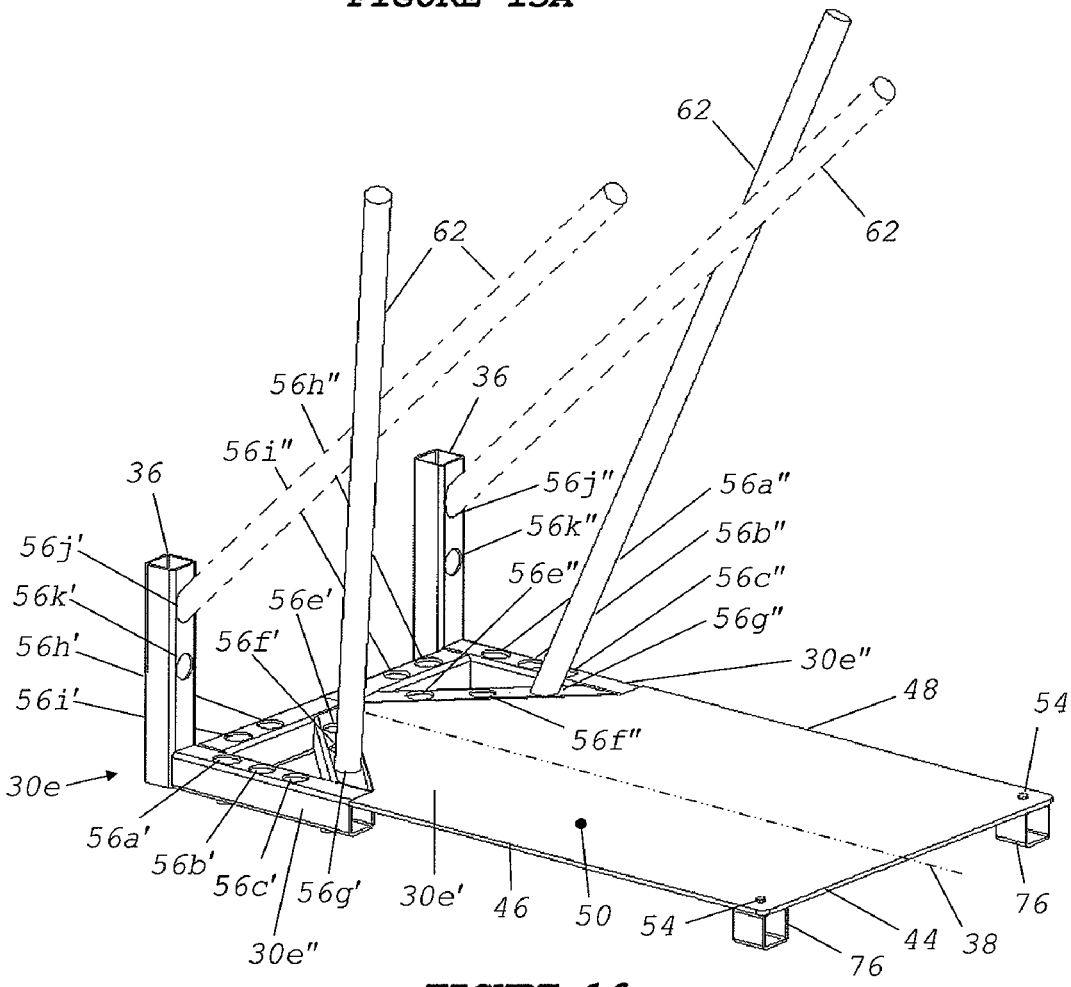
FIG. 16 is a perspective view of an embodiment of the exercise apparatus of the present invention.

The embodiment of the base 30*e* of the present invention illustrated in FIG. 16 is generally horizontally oriented and comprises main base portion 30*e*', several horizontally oriented tubular base portions 30*e*", two protruding base portions 36 (each of which defines connection interfaces 56 at different locations and orientations relative to the user and can be attached using bolts, welds, or other similar attachment means), and two base pads 76 attached to the base 30 using base bolts 54. The exercise apparatus of the present invention illustrated in FIG. 16 comprises four resilient members 62 simultaneously inserted into four connection interfaces 56. The two resilient members 62 illustrated in phantom lines are shown merely to illustrate the orientation of the connection interfaces 56*j*' and 56*j*" only. It is not required or even beneficial that more than one or two resilient members are simultaneously inserted into the connection interfaces. As mentioned, the base 30*e* is comprised of multiple tubular members preferably formed from tubing with a hollow, rectangular cross-section and one large, flat plate member, fixed together using bolts, screws, brackets, welds, adhesive, notches, protrusions, or by any other suitable fastening means. The left side connection interfaces 56*a*'-56*k*' and the right side connection interfaces 56*a*"-56*k*" are symmetrical about a plane normal to the primary surface 50 and intersecting centerline 38.

Figure 17:
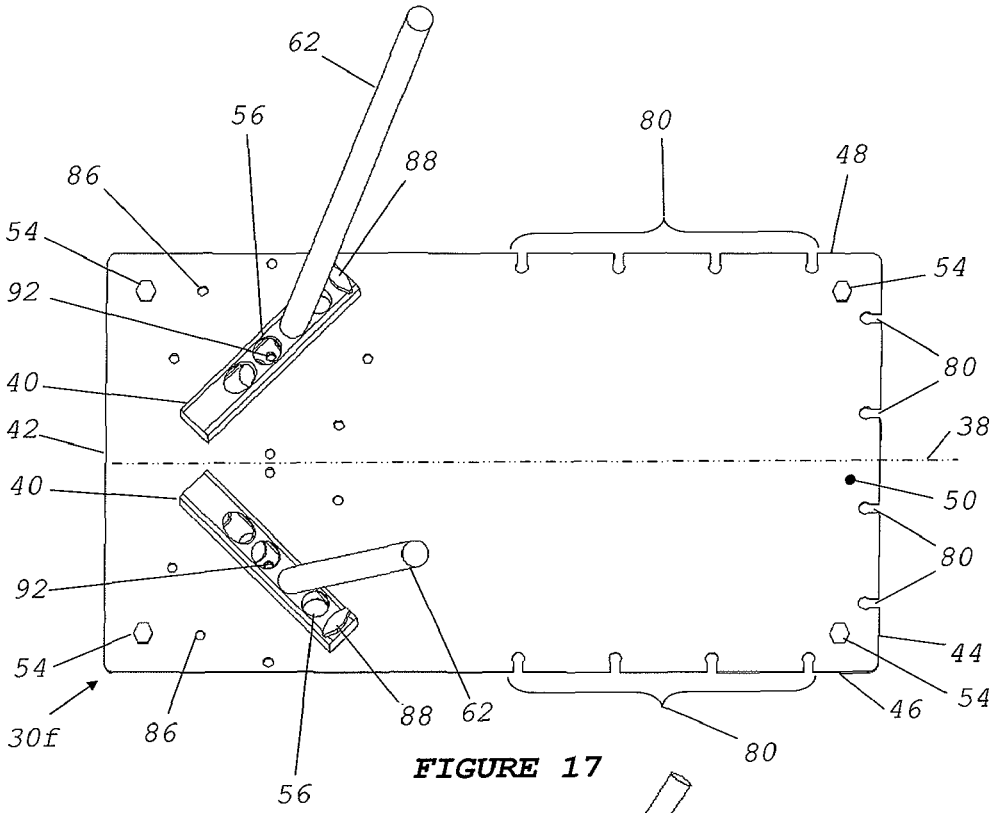
FIG. 17 is a perspective view of an embodiment of the exercise apparatus of the present invention.

The embodiment of the present invention illustrated in FIG. 17 comprises base 30*f*, two resilient members 62, two adjustable base members 40, rotation pins 92 attached to base 30*f* through a hole in each of the adjustable base members and about which adjustable base members 40 rotate, multiple insert pin openings 86 cut into the base 30 preferably in a radial arrangement about the rotation pin 92, and two insert pins 88 that lock each of the adjustable base members 40 in the desired angular orientation by engaging in the desired insert pin openings 86. Insert pins 88 and insert pin openings 86 can be threaded or define other features to prevent the inadvertent removal of the insert pins 88. Each of the adjustable base members 40 define multiple connection interfaces 56 at different locations and angular orientations for receiving the resilient member 62. By altering the angular orientation of each of the adjustable base members 40 and/or inserting the resilient member 62 into a different connection interface 56, the exercise apparatus of the present invention can be configured to permit the user to perform a wide range of exercises. Base 30*f* further defines base notches 80 cut into the perimeter of the base into which resistance bands and other similar devices can be secured to permit the user to perform additional exercises when standing, kneeling, or sitting on the base.

Figure 18:
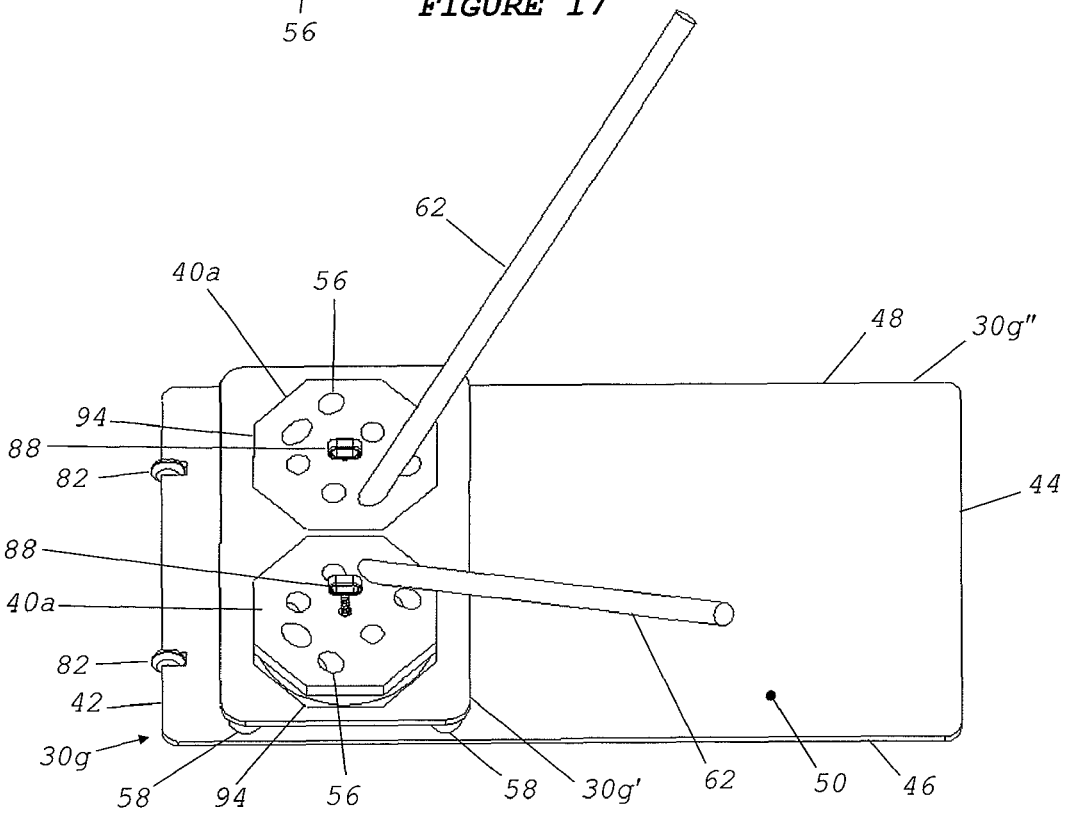
FIG. 18 is an exploded perspective view of an embodiment of the exercise apparatus of the present invention

Similar to the embodiment illustrated in FIG. 17, the embodiment of the present invention illustrated in FIG. 18 also permits the user to adjust the location and angular orientation of the resilient members 62 by varying the angular orientation of the adjustable base members 40*a* and/or inserting the resilient members 62 into one of a plurality of connection interfaces 56 on each adjustable base members 40*a*, seven being shown. Each connection interface 56 is arranged at a different location and angular orientation on the adjustable base member 40*a*. Base 30*g* defines upper base portion 30*g*' and lower base portion 30*g*" which are preferably separated from one another using multiple base member spacers 58 which are attached to the base 30*g* using bolts, welds, adhesive, or any other suitable connection means. The upper base portion 30*g*' has two cutouts 94 into which each adjustable base member 40*a* is removably inserted. The two adjustable base members 40*a* are secured in the desired angular orientation by inserting the insert pin 88, which is located at the center point of each of the adjustable base members 40*a* and passes through the adjustable base members 40*a*, into a hole located in the base 30 and aligned with insert pin 88.

In the embodiment illustrated in FIG. 18, both the insert pin 88 and the base hole into which the insert pin 88 is inserted preferably comprise locking features, such as threads, pins, protrusions, channels, or other suitable features so that, when the insert pin 88 is engaged in the base hole, the adjustable base members 40*a* are firmly secured to the base 30*g*. The insert pin 88, the base hole, and the cutouts 94 in the base 30*g* prevent the adjustable base members 40*a* from rotating, translating, or otherwise moving from the desired location. The user adjusts the angular orientation of the adjustable base members 40*a* by removing the insert pin 88, lifting the adjustable base member 40*a* out of the cutout 94, changing the angular orientation of the adjustable base members 40*a*, and then reinserting adjustable base member 40*a* into the cutout 94, and inserting the insert pin 88 into the base hole. Each cutout 94 is defined by a geometry approximately matching, but slightly oversized as compared to, the geometry of the side surfaces of each of the adjustable base members 40*a* such that each of the adjustable base members 40*a* can be removably but snuggly inserted partially or fully into each of the two cutouts 94. Base 30*g* further defines two base wheels 82 to facilitate transport of the base.

The embodiment of the present invention illustrated in FIG. 19 permits the user to adjust the location and angular orientation of the resilient members 62*c* by varying the angular orientation of the adjustable base members 40*b* with respect to the mount assembly 98. The base 30*h* can be oriented at any angle, horizontal, vertical, or otherwise. Each of the two adjustable base members 40*b* independently rotate about mount assembly axle 106 so that the angular orientation of the adjustable base members 40*b* and, consequently, the resilient members 62*c*, can be adjusted by the user of this device. Each of the adjustable base members 40*b* is locked by the user in the desired angular orientation by inserting the mount assembly adjustment pin 104, which is mounted to and can translate through the mount assembly pin bracket 108 into any one of the holes of the mount assembly radial hole bracket 102. Mount assembly pin bracket 108 is fixed to the base 30*h* by bolting, screwing, welding, or by suitable features or methods. Mount assembly radial hole bracket 102 is fixed to the mount assembly axle 106 so that it rotates along with the adjustable base member 40*b*. A "W" shaped handle assembly 114 is preferably attached to the caps 72 of the resilient members 62*c* using a hand bolt, screw, or other suitable attachment means. Attaching a "W" shaped handle or any other handle to the resilient members permits the user to perform a wider variety of exercises by providing different positions where the user can grip the exercise apparatus of the present invention. Other handles, such as rope handles, individual handles, or straight handles, can be similarly attached to the resilient members to enable a variety of additional gripping points for the user.

Further adjustability of the angular orientation of the mount assembly 98 with respect to the base can be achieved by mounting the mount assembly 98 to a freely rotatable but lockable plate. The rotating plate would be locked into the desired angular orientation by inserting an insert pin or other suitable locking mechanism through the rotatable plate into an insert pin opening in the base. Alternatively, the rotatable plate could comprise a foot pedal attached to the insert pin so that, by pressing the pedal, the insert pin can be disengaged from the aforementioned array of insert holes in base and permit the free rotation of the rotatable plate. By releasing the pedal when the rotatable plate is in the desired orientation, the pin or other suitable component will be engaged in the array of insert holes in base.

Figure 20:
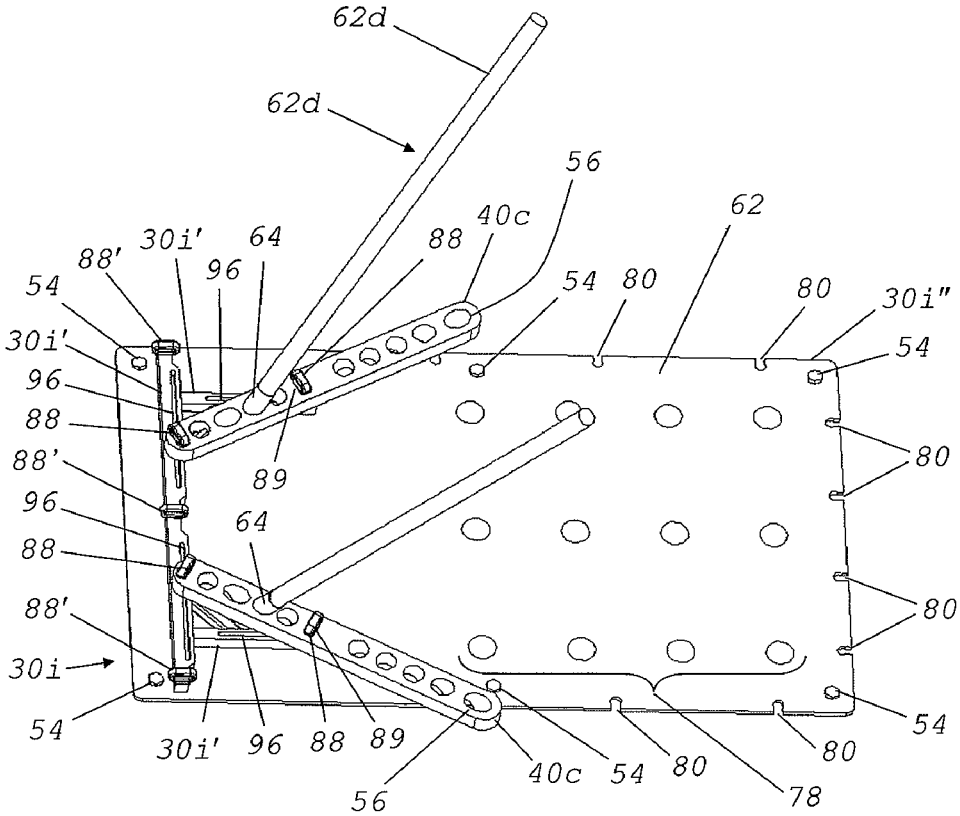
FIG. 20 is a perspective view of an embodiment of the exercise apparatus of the present invention.
Figure 21A:
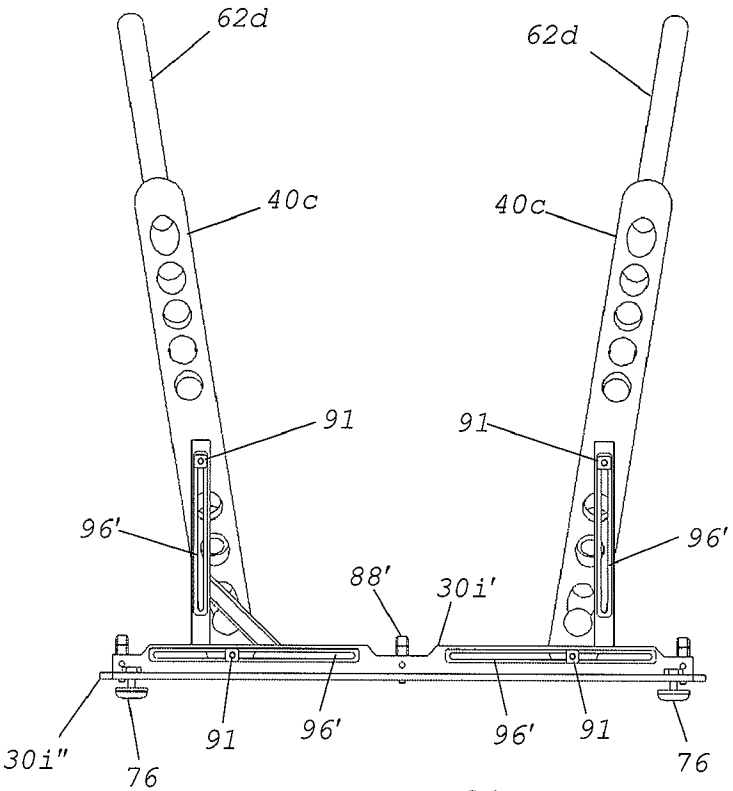
FIG. 21*a* is a back view of the embodiment of the exercise apparatus of the present invention illustrated in FIG. 21 taken along line 21*a*-21*a* in FIG. 21.
Figure 21:
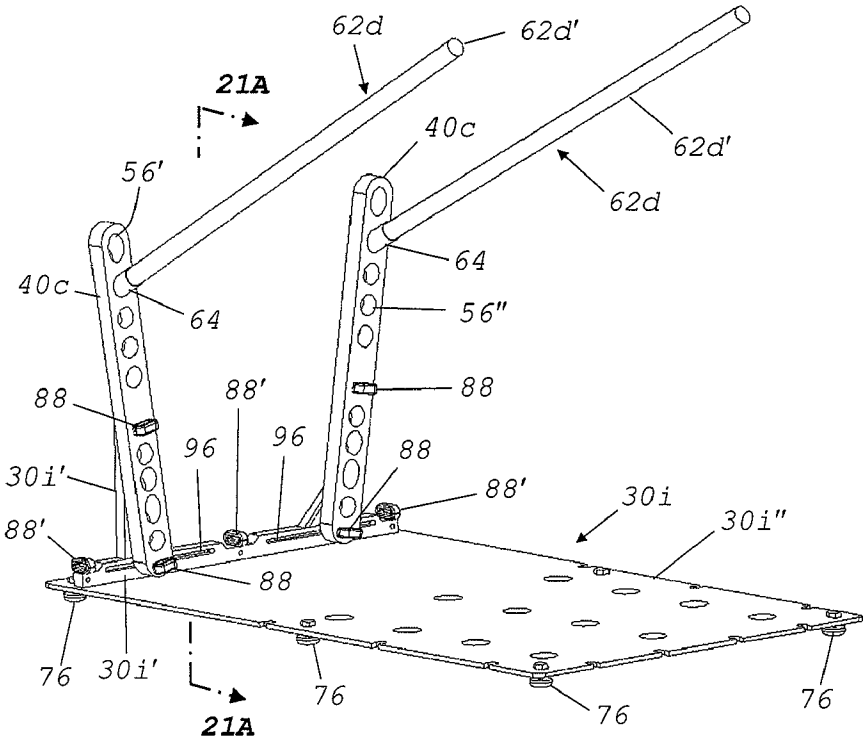
FIG. 21 is a perspective view of an embodiment of the exercise apparatus of the present invention.

The embodiment of the present invention illustrated in FIGS. 20, 21*a*, and 21*b* also permits the user to adjust the location and angular orientation of the resilient members 62*d* by varying the angular orientation of the adjustable base members 40*c* and/or inserting the resilient members 62*d* into one of the nine connection interfaces 56 on each adjustable base members 40*c*. Each connection interface 56 is preferably arranged at a different location and angular orientation on the adjustable base member 40*c*. Multiple upper base portions 30*i*' having a generally rectangular cross-section are fixed to the lower base portion 30*i*" by threaded insert pins 88'. The user adjusts the angular orientation of the adjustable base members 40*c* by loosening and sliding the threaded insert pins 88, and hence the adjustable base member 40*c*, to a different position in slots 96 and then tightening the threaded insert pins 88. To secure each adjustable base member 40*c* in its desired position, each of the threaded insert pins 88 pass through a hole 89 in the adjustable base member 40*c*, through slot 96, and engage in the nut 91 that is slidably positioned within the larger slot 96' formed on the bottom sides of the upper base portions 30*i*'. The base 30*i* further comprises base notches 80 and base depressions 78, both of which can be incorporated into any embodiment of the present invention. FIG. 21 illustrates the identical embodiment of the present invention illustrated in FIG. 20, except that upper base portions 30*i*' are fixed in a generally vertical orientation to the base 30*i* using threaded insert pins 88', permitting the user to further vary the location and orientation of each resilient member 62*d*.

Figure 22A:
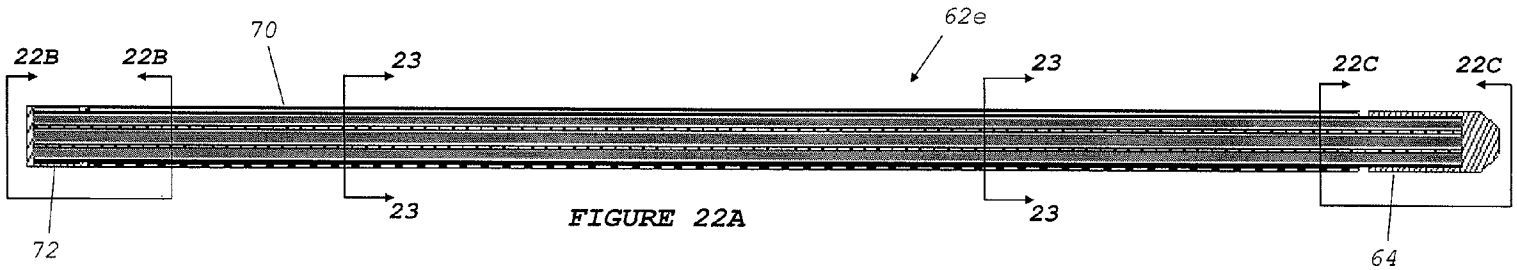
FIGS. 22*a*, 22*b*, and 22*c* are sectional views of an embodiment of the resilient member of the present invention.
Figure 22C:
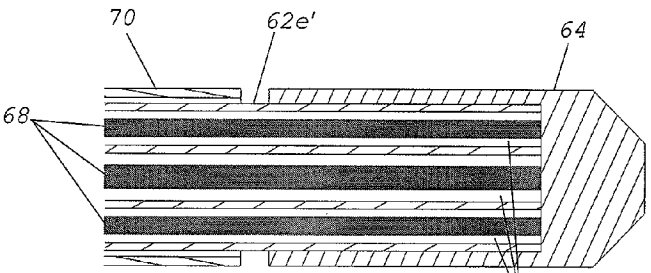
Figure 22B:
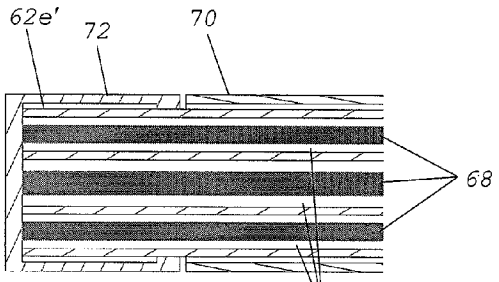
Figure 23:
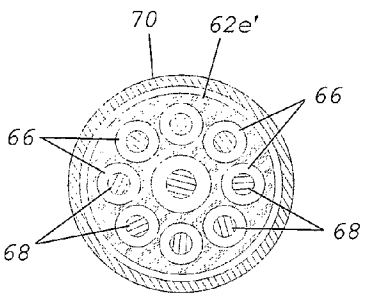
FIG. 23 is a sectional view of the embodiment of the resilient member of the present invention taken along line 23-23 in FIG. 22*a*.

FIGS. 22*a*, 22*b*, and 22*c* are longitudinal cross-sectional views, and FIG. 23 is transverse cross-sectional view, of an embodiment of a resilient member 62*e* comprising multiple stiffener members 68 which, when inserted by the user into the longitudinal bores 66 of resilient member 62*e*', increase the stiffness and resistance of the resilient member 62*e*. Resilient member 62*e*' can comprise multiple longitudinal bores 66 (as shown in the embodiment illustrated in FIGS. 22 and 23), or merely one longitudinal bore 66 into which one or more stiffener members 68 can be inserted. Thus, resilient member 62*e*' can be solid in cross-section or hollow with any number of longitudinally oriented longitudinal bores 66 therein, as described above. The stiffener members 68 can be any of a variety of diameters, geometries, and stiffnesses, so long as they fit inside longitudinal bores 66. Additionally, sleeve 70 having a toroidally shaped cross-section can be inserted by the user over the outer surface of the resilient member 62*e*' to achieve greater stiffness and, hence, resistance of the resilient member 62*e*. The resilient member 62*e* depicted in the embodiment of the present invention illustrated in FIGS. 22-23 can be interchanged with any of the aforedescribed resilient member described herein.

Referring to FIGS. 22*a* and 22*b*, the cap 72 is affixed onto the unrestrained end of the resilient member 62*e*' to seal the longitudinal bore or bores 66 and encapsulate stiffener members 68. Cap 72 preferably provides an interface with the resilient member 62*e*' to which the "W" shaped handle 114, rope handle, individual handle, or any other handle or attachments that the user desires can be attached by using a hand bolt, screw, or other suitable attachment means. Cap 72 and resilient member 62*e*' preferably define threads, pins, protrusions, or other suitable locking features to firmly secure the cap 72 to the resilient member 62*e*'.

Resilient member 62', stiffener member 68, and sleeve 70 can be manufactured from any resilient material, e.g., a polymer, elastomer, a pliable metallic alloy, plastic-fiberglass or other fiber composite, or any other suitable material that will elastically bend without permanent deformation when force as applied by the user, such as any one or more of the following: nylon, delrin, polyvinyl chloride, rubber, elastomeric materials, aluminum, steel, spring steel, carbon, or glass elastomers, or any other suitable materials that can form a flexible yet stiff resilient member. The resilient member can be of any cross-sectional geometry and can be straight, angled, or curved to accommodate different exercises. The length of the resilient member preferably ranges from approximately twelve inches to approximately sixty inches depending on the exercise the resilient member is to be used for. However, the length is not so limited. The diameter or cross-sectional width of the resilient member can similarly vary between approximately one-half inch to two inches, depending on the desired stiffness and other factors, such as user comfort, but is preferably in the range of one inch to one and a half inches. The cap 72 and insert 64 can be manufactured from any rigid material, e.g., a polymer, metal or metal alloy, plastic-fiberglass or other fiber composite, or any other suitably rigid material.

Figure 24C:
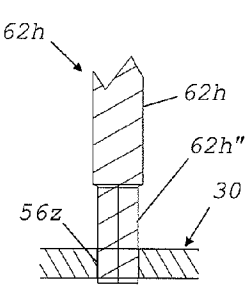
FIG. 24*c* is a sectional view of an embodiment of the resilient member and an embodiment of the connection interface of the present invention.
Figure 24B:
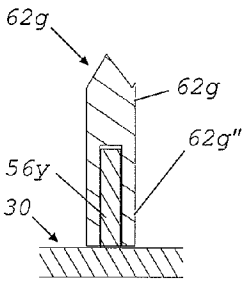
FIG. 24*b* is a sectional view of an embodiment of the resilient member and an embodiment of the connection interface of the present invention.
Figure 24A:
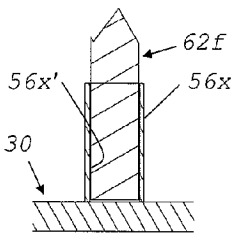
FIG. 24*a* is a sectional view of an embodiment of the resilient member and an embodiment of the connection interface of the present invention.

The geometry of the connection interfaces 56 can be generally cylindrical or conical, or can be of any cross-sectional geometry, square, hexagonal, or otherwise. The geometry of the embodiment of the connection interface 56*x* illustrated in FIG. 24*a* is cylindrical, defining a cylindrical interior portion 56*x*' into which resilient member 62*f* is inserted. Connection interface 56*x* protrudes from the base 30 a sufficient distance, preferably three inches, to ensure that the resilient member is securely engaged. The embodiment of the connection interface 56*y* illustrated in FIG. 24*b* is configured as a cylindrical projection projecting from the base. Resilient member 62*g* is attached to connection interface 56*y* such that the connection interface 56*y* fits snuggly into the cylindrical opening 62*g*" in the end of the resilient member 62*g*. Connection interface 56*y* protrudes from the base 30 a sufficient distance, preferably three inches, to ensure that the resilient member is securely engaged. The connection interface 56*z* illustrated in FIG. 24*c* is formed of a square cutout in base 30. The portion of the resilient member 62*h*" that is inserted into connection interface 56*z* has an outer surface geometry that substantially matches the geometry of the interior surface of the connection interface 56*z* but is sized to fit snuggly within the connection interface 56*z*. Further, the end of the resilient member 62 that is attached to a connection interface, i.e., either the end of the resilient member 62' or the insert 64, can be threaded, notched, or contain some other protrusion to prevent it from becoming inadvertently unattached from the connection interface 56. The connection interface 56 would also comprise complementary locking features. Alternatively, the resilient member 62 can be devoid of any locking features on its exterior surface so that it can be easily removed from the connection interfaces 56. A connection interface defining a conical geometry is preferable because, when the surface of the resilient member that mates with the connection interface is also conical, the resilient member can be inserted firmly to ensure a snug fit between the connection interface and the resilient member.

It is believed that the exercise apparatus of the present invention will be understood from the foregoing description, and it will be apparent that various changes may be made in the form, construction and arrangement of the parts without departing from the spirit or scope of the invention or sacrificing all of the material advantages, the forms herein above described being merely preferred or exemplary embodiments thereof.

What is claimed is:

1. A device for exercising the muscles in one's body, said device comprising:

a first base portion and a second base portion supported by a support surface, the support surface defining a normal axis that is perpendicular to the support surface;

a first set of connection interfaces supported by the first base portion comprising a first connection interface having a first axial centerline and positioned at a first angular orientation and a second connection interface having a second axial centerline and positioned at a second angular orientation that is different than the first angular orientation;

a second set of connection interfaces supported by the second base portion comprising a third connection interface having a third axial centerline and positioned at a third angular orientation and a fourth connection interface having a fourth axial centerline and positioned at a fourth angular orientation that is different than the third angular orientation; and at least one independently deflectable resilient member configured to produce a resistance force when a user exerts a force thereon so as to deflect at least a portion of each resilient member from the longitudinal axis of the relaxed position of each resilient member;

wherein:

each connection interface is configured to provide a removable support for each resilient member so as to support each resilient member in a cantilever disposition;

the first axial centerline and the second axial centerline define a first plane;

the third axial centerline and the fourth axial centerline define a second plane; and the first plane is not coplanar with the second plane.

2. The device of claim 1, comprising:

a first resilient member configured to be supported by any one of the connection interfaces in a cantilever disposition;

a second resilient member configured to be supported by any one of the connection interfaces in a cantilever disposition;

wherein:

the first and second resilient members are configured to produce a resistance force when a user exerts a force thereon so as to bend at least a portion of the resilient member, effecting an exercising of one or more muscles in the user's body;

the first resilient member is stiffer than the second resilient member such that a greater force is required to bend at least a portion of the first resilient member as compared to the second resilient member; and each connection interface is configured to support either one of the first and second resilient members.

3. The device of claim 1, wherein the first plane is not parallel to the second plane.

4. The device of claim 1, wherein the first connection interface is positioned at a non-zero, positive angle relative to the normal axis and the second connection interface is positioned at a non-zero, negative angle relative to the normal axis such that the first and second connection interfaces are angled in opposite directions.

5. The device of claim 1, wherein the support surface is a ground surface or floor.

6. The device of claim 1, wherein one or more of the connection interfaces comprises an opening configured to provide the removable support for the at least one resilient member so as to support the at least one resilient member in a cantilever disposition.

7. The device of claim 6, wherein at least a portion of one or more openings is generally cylindrically shaped.

8. A method of exercising one or more muscles of the body using the device of claim 1, comprising, in any order:

supporting at least a portion of the at least one resilient member with the first connection interface;

grasping the at least one resilient member with one's hand or hands;

exerting a force on the at least one resilient member so as to deflect at least a portion of the resilient member from the longitudinal axis of the relaxed position of the resilient member and effect an exercising of one or more muscles in the user's body; and adjusting the angular orientation of the centerline of the at least one resilient member from the first angular orientation to the second angular orientation by disengaging the resilient member from the first connection interface and supporting the resilient member with the second connection interface.

9. The device of claim 1, comprising three or more independently deflectable resilient members.

10. The device of claim 1, further comprising an axially resilient resistance member, wherein a portion of the axially resilient resistance member is removably supportable by the device.

11. The device of claim 1, wherein at least one resilient member comprises one or more of teeth, a spline, a protrusion, a channel, and a notch formed in a portion of the resilient member configured to be received by or in one of the connection interfaces.

12. The device of claim 1, wherein at least one resilient member comprises a support element and a resilient element coupled with the support element, the support element being supportable by one of the connection interfaces and the resilient element having a different diameter or cross-sectional size than a diameter or cross-sectional size of the connection interfaces.

13. The device of claim 1, wherein one or more of the connection interfaces comprises a projection extending from the first and/or second base portion, each projection being configured to provide a removable support for at least an end portion of at least one resilient member.

14. The device of claim 1, further comprising a sleeve element positioned around at least a portion of the outside surface of at least one resilient member.

15. The device of claim 1, wherein the device comprises one or more releasable locking features configured to prevent the inadvertent disengagement of the resilient member from the connection interface defining the support for the resilient member.

16. The device of claim 1, wherein at least one of the first base portion and the second base portion is rotatable and/or moveable so that the orientation and/or location of at least one of the first base portion and the second base portion is adjustable.

17. The device of claim 1, wherein the device is configured such that the first base portion and the second base portion are attachable to the support surface, and the support surface is vertically oriented, horizontally oriented, or otherwise.

18. The device of claim 1, wherein the device is configured such that the first base portion and the second base portion are attachable to a vertically oriented support surface.

19. The device of claim 1, comprising a base supporting the first base portion and the second base portion, the base being configured to support a user in a standing, kneeling, sitting, or other position.

20. The device of claim 1, wherein the first base portion comprises four or more connection interfaces, each connection interface supported by the first base portion having a different angular orientation than the other connection interfaces supported by the first base portion, and the second base portion comprises four or more connection interfaces, each connection interface supported by the second base portion having a different angular orientation than the other connection interfaces supported by the second base portion, and wherein the device is configured such that the orientation of at least one resilient member can be varied from an angle that is approximately parallel to the support surface to an angle that is approximately perpendicular to the support surface, and at least one angle therebetween.

21. The device of claim 1, wherein the device is configured to support a portion of one or more axially resilient resistance members.

22. The device of claim 1, wherein at least one resilient member is configured to support at least one of a rope, an individual handle, a "W" shaped handle, or other handle member configured to change the location and/or orientation of a user's hand grip relative to the resilient member.

23. The device of claim 1, wherein at least one resilient member comprises one or more fiberglass rods configured to produce a resistance force when a user exerts a force thereon so as to deflect at least a portion of each fiberglass rod from the longitudinal axis of the relaxed position of each fiberglass rod.

24. The device of claim 1, wherein at one least resilient member comprises one or more fiberglass rods, and wherein an end portion of the one or more fiberglass rods is supported by a support member of the resilient member.

25. A device for exercising one or more muscles of the body, comprising:

a base comprising a first base member;

a plurality of connection interfaces supported by the base, at least one of the connection interfaces being supported by the first base member; and a plurality of resilient members, comprising:

a first resilient member configured to be supported by any one of the connection interfaces in a cantilever disposition such that a first end of the first resilient member is prevented from pivoting relative to the base; and a second resilient member configured to be supported by any one of the connection interfaces in a cantilever disposition such that a first end of the second resilient member is prevented from pivoting relative to the base;

wherein:

the first and second resilient members are configured to produce a resistance force when a user exerts a force thereon so as to bend at least a portion of the resilient member, effecting an exercising of one or more muscles in the user's body;

the first resilient member is stiffer than the second resilient member such that a greater force is required to bend at least a portion of the first resilient member as compared to the second resilient member;

each connection interface is configured to support any one of the plurality of resilient members; and the angular orientation of a centerline of at least a portion of each of the plurality of resilient members is adjustable from a first angular orientation to at least a second angular orientation different from the first angular orientation without deflecting the resilient member from the longitudinal axis of the relaxed position of the resilient member by either disengaging the resilient member from the connection interface defining the first angular orientation and supporting the resilient member in another connection interface having the second angular orientation or by adjusting an angular orientation of the connection interface defining the support for the resilient member from the first angular orientation to the second angular orientation.

26. The device of claim 25, wherein each of the first and second resilient members comprise a support portion and a resilient portion, and wherein the support portion of the first resilient member has approximately the same shape as the support portion of the second resilient member.

27. The device of claim 26, wherein a cross-sectional size of the resilient portion of the first resilient member is larger than a cross-sectional size of the resilient portion of the second resilient member.

28. The device of claim 26, wherein at least one of the first and second resilient members comprises one or more fiberglass rods, and wherein an end portion of the one or more fiberglass rods is supported by the support portion of the resilient member.

29. The device of claim 25, comprising a third resilient member, wherein the third resilient member is stiffer than the first resilient member such that a greater force is required to bend at least a portion of the third resilient member as compared to the first resilient member.

30. The device of claim 25, further comprising a sleeve element positioned around at least a portion of the outside surface of at least one of the plurality of resilient members.

31. The device of claim 25, wherein at least one of the connection interfaces protrudes from the base.

32. The device of claim 25, wherein the shape of the inside surface of at least one of the connection interfaces is cylindrical.

33. The device of claim 25, wherein at least one of the first and second resilient members is configured to support a removable or non-removable stiffener member in a cantilever disposition, the stiffener member being configured to increase the bending resistance of the resilient member.

34. The device of claim 25, wherein one or more of the resilient members comprises one or more of splines, teeth, protrusions, channels, and notches formed in a portion of the resilient member configured to be received by or in one of the connection interfaces.

35. The device of claim 25, wherein the device comprises one or more releasable locking features configured to prevent the inadvertent disengagement of the resilient member from the connection interface defining the support for the resilient member.

36. A device for exercising the muscles in one's body, said device comprising:

at least one base element supportable by a support surface, the support surface defining a normal axis that is perpendicular to the support surface;

at least one resilient member, each configured to produce a resistance force when a user exerts a force thereon so as to deflect at least a portion of the resilient member from a longitudinal axis of the relaxed position of the resilient member; and a first set of connection interfaces comprising a first connection interface, a second connection interface, and a third connection interface supported by the at least one base element;

wherein:

each connection interface is configured to provide a removable support for the at least one resilient member so as to support the at least one resilient member in a cantilever disposition;

the first connection interface is positioned at a different angular orientation relative to the normal axis as compared to the second connection interface;

the third connection interface is positioned at a different angular orientation relative to the normal axis as compared to the first and second connection interfaces;

the first and second connection interfaces are angled generally toward a user of the device;

the third connection interface is angled generally away from a user of the device; and the device is configured such that the angular orientation of the longitudinal axis of at least a portion of each resilient member is adjustable from a first angular orientation to at least a second angular orientation that is different than the first angular orientation without deflecting the resilient member from the longitudinal axis of the relaxed position of the resilient member by varying the connection interface providing the removable support for the resilient member.

37. The device of claim 36, wherein one or more of the connection interfaces comprises an opening configured to provide the removable support for the at least one resilient member so as to support the at least one resilient member in a cantilever disposition.

38. The device of claim 37, wherein at least one resilient member comprises a support element and a resilient element coupled with the support element, the support element being configured to be supported by one of the connection interfaces and the resilient element having a larger diameter or cross-sectional size than a diameter or cross-sectional size of the connection interfaces.

39. The device of claim 36, wherein one or more of the connection interfaces comprises a projection extending from the base element, each projection being configured to provide a removable support for at least an end portion of at least one resilient member.

40. The device of claim 36, wherein the device comprises one or more releasable locking features configured to prevent the inadvertent disengagement of the resilient member from the connection interface defining the support for the resilient member.

41. The device of claim 36, wherein the at least one base element is rotatable and/or moveable so that the orientation and/or location of the at least one base element is adjustable.

42. The device of claim 36, wherein the at least one base element is configured to be attached to the support surface, and the support surface is vertically oriented, horizontally oriented, or otherwise.

43. The device of claim 36, comprising a base supporting the at least one base element, the base being configured to support a user in a standing, kneeling, sitting, or other position.

44. The device of claim 36, wherein at least one base element comprises four or more connection interfaces, each connection interface having a different angular orientation than the other connection interfaces supported by the respective base element.

45. The device of claim 36, wherein the device is configured to support a portion of one or more axially resilient resistance members.

46. The device of claim 36, wherein the device is configured such that the angular orientation of the longitudinal axis of at least a portion of each resilient member is adjustable to a third and a fourth angular orientation that are each different from one another and each different from the first and second angular orientations without deflecting the resilient member from the longitudinal axis of the relaxed position of the resilient member.

47. The device of claim 36, wherein the device is configured such that the angular orientation of at least one resilient member can be varied from an angle that is approximately parallel to the support surface to an angle that is approximately perpendicular to the support surface, and at least one angle therebetween.

48. The device of claim 36, wherein at least one resilient member comprises one or more fiberglass rods.

49. A device for exercising the muscles in one's body, said device comprising:

a first base portion and a second base portion supported by a support surface, the support surface defining a normal axis that is perpendicular to the support surface;

a first set of connection interfaces supported by the first base portion comprising a first connection interface having a first axial centerline and positioned at a first angular orientation and a second connection interface having a second axial centerline and positioned at a second angular orientation that is different than the first angular orientation;

a second set of connection interfaces supported by the second base portion comprising a third connection interface having a third axial centerline and positioned at a third angular orientation and a fourth connection interface having a fourth axial centerline and positioned at a fourth angular orientation that is different than the third angular orientation;

a fifth connection interface having a fifth axial centerline and positioned at a fifth angular orientation; and at least one resilient member configured to produce a resistance force when a user exerts a force thereon so as to deflect at least a portion of the at least one resilient member from the longitudinal axis of the relaxed position of the at least one resilient member;

wherein:

each connection interface is configured to provide a removable support for a one resilient member so as to support the resilient member in a cantilever disposition;

the first axial centerline and the second axial centerline define a first plane;

the third axial centerline and the fourth axial centerline define a second plane;

the fifth axial centerline is not in the first plane or the second plane; and the first plane is not coplanar with the second plane.

50. The device of claim 49, comprising:

a first resilient member configured to be supported by any one of the connection interfaces in a cantilever disposition;

a second resilient member configured to be supported by any one of the connection interfaces in a cantilever disposition;

wherein:

the first and second resilient members are configured to produce a resistance force when a user exerts a force thereon so as to bend at least a portion of the resilient member, effecting an exercising of one or more muscles in the user's body;

the first resilient member is stiffer than the second resilient member such that a greater force is required to bend at least a portion of the first resilient member as compared to the second resilient member; and each connection interface is configured to support either one of the first and second resilient members.

51. The device of claim 49, wherein the first plane is not parallel to the second plane.

52. The device of claim 49, wherein the first connection interface is positioned at a non-zero, positive angle relative to the normal axis and the second connection interface is positioned at a non-zero, negative angle relative to the normal axis such that the first and second connection interfaces are angled in opposite directions.

53. The device of claim 49, wherein one or more of the connection interfaces comprises an opening configured to provide the removable support for the at least one resilient member so as to support the at least one resilient member in a cantilever disposition.

54. A method of exercising one or more muscles of the body using the device of claim 49, comprising, in any order:

supporting at least a portion of the at least one resilient member with the first connection interface;

grasping the at least one resilient member with one's hand or hands;

exerting a force on the at least one resilient member so as to deflect at least a portion of the resilient member from the longitudinal axis of the relaxed position of the resilient member and effect an exercising of one or more muscles in the user's body; and adjusting the angular orientation of the centerline of the at least one resilient member from the first angular orientation to the second angular orientation by disengaging the resilient member from the first connection interface and supporting the resilient member with the second connection interface.

55. The device of claim 49, comprising two or more resilient members.

56. The device of claim 49, further comprising an axially resilient resistance member, wherein an end portion of the axially resilient resistance member is removably supportable by the device.

57. The device of claim 49, wherein the device comprises one or more releasable locking features configured to prevent the inadvertent disengagement of the resilient member from the connection interface defining the support for the resilient member.

58. The device of claim 49, wherein at least one of the first base portion and the second base portion is rotatable and/or moveable so that the orientation and/or location of at least one of the first base portion and the second base portion is adjustable.

59. The device of claim 49, comprising a base supporting the first base portion and the second base portion, the base being configured to support a user in a standing, kneeling, sitting, or other position.

60. The device of claim 49, wherein the first base portion comprises four or more connection interfaces, each connection interface supported by the first base portion having a different angular orientation than the other connection interfaces supported by the first base portion, and the second base portion comprises four or more connection interfaces, each connection interface supported by the second base portion having a different angular orientation than the other connection interfaces supported by the second base portion, and wherein the device is configured such that the orientation of at least one resilient member can be varied between an angle that is approximately parallel to the support surface, an angle that is approximately perpendicular to the support surface, and at least one angle therebetween.

61. The device of claim 49, wherein the device is configured to support an end portion of one or more axially resilient resistance members.

62. The device of claim 49, wherein at least one resilient member is configured to support at least one of a rope, an individual handle, a "W" shaped handle, or other handle member configured to change the location and/or orientation of a user's hand grip relative to the resilient member.

* * * * *